United States Patent [19]

Humphries et al.

[11] 4,215,781

[45] Aug. 5, 1980

[54] ARTICLE CARRIER WITH GUSSET RETAINERS

[75] Inventors: Richard L. Humphries, Sunnyvale; Hans Eide, Foster City, both of Calif.

[73] Assignee: Kliklok Corporation, Greenwich, Conn.

[21] Appl. No.: 24,457

[22] Filed: Mar. 27, 1979

[51] Int. Cl.[2] ..... B65D 5/02; B65D 75/06; B65D 85/62

[52] U.S. Cl. ..... 206/434; 229/40; 229/52 BC

[58] Field of Search ..... 206/434, 165, 161; 229/40, 28 BC, 52 BC

[56] References Cited

U.S. PATENT DOCUMENTS

| | | | |
|---|---|---|---|
| 3,562,005 | 3/1972 | Morgese | 229/40 |
| 3,679,121 | 7/1972 | Morgese | 229/40 |
| 3,963,121 | 6/1976 | Kipp | 206/434 |

*Primary Examiner*—William T. Dixson, Jr.
*Attorney, Agent, or Firm*—Lowe, King, Price & Becker

[57] ABSTRACT

An article carrier of the wraparound type formed from a single sheet of paperboard and having top, bottom, and side panels separated by fold lines and which includes article retaining gussets formed at the corners of the bottom and side panels, the gussets being held in place by the weight of the article. Each gusset is formed having three triangular sections separated from each other and the side and bottom panels by fold lines, with a first section adjacent the bottom panel being folded through 180° to lie flat on the bottom panel. The middle section is folded on top of the first section which causes the remaining section adjacent to the side panel to be erected in its retaining position. Articles contained within the carrier rest on the two folded sections to secure the retaining gussets and prevent movement of the articles.

5 Claims, 5 Drawing Figures

Fig. 1
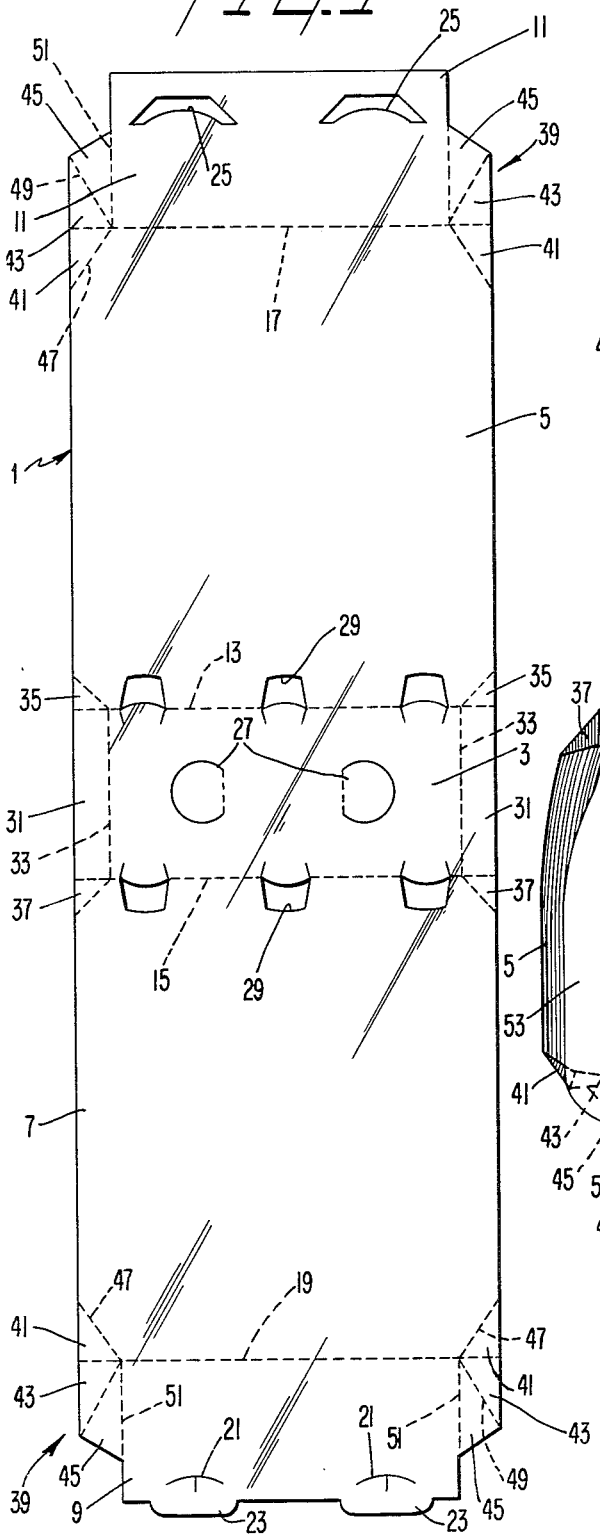
Fig. 3
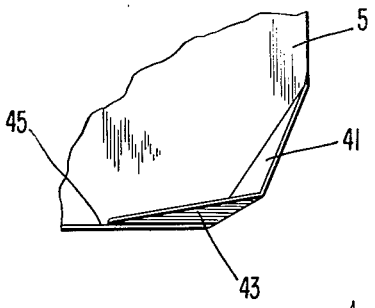
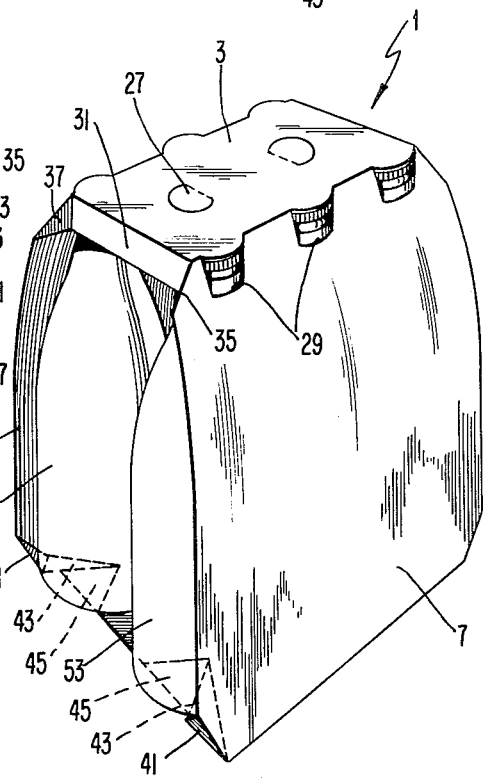
Fig. 2

ARTICLE CARRIER WITH GUSSET RETAINERS

BACKGROUND OF THE INVENTION

The invention relates to the field of article carriers and more particularly to article carriers of the wraparound type which include article retaining flaps or gussets.

Various types of article carriers are known in the art. Article carriers of interest with respect to this invention include those of the "wraparound" type for holding bottles and cans, the carrier being formed from a single sheet of foldable material, such as paperboard. Such carriers are characterized in that they are formed having top, bottom, and side panels separated by fold lines. The article carrier is assembled by folding the panels to form a generally rectangular-shaped package with the two outermost panels being joined by adhesive or locking tabs, such as shown in U.S. patent to Pierce, U.S. Pat. No. 3,374,938, assigned to the assignee of the present invention.

It will be appreciated that some means for securely retaining the articles contained within the carrier must be provided. Especially in the case of bottled beverages, a certain amount of shifting of the bottles is to be expected during shipping and handling, which can lead to breakage problems if the bottles are not securely retained within the carrier.

In the early Pierce U.S. Pat. No. 3,374,938, this retaining means took the form of side cut-out openings adjacent the bottom panel. While this arrangement worked well, the ends of the wrapper had no positive means to retain the bottles and to protect the bottles at the vulnerable corners of the package. This prior carrier also used extra paperboard along the bottom panels. Furthermore, the prior art arrangement is generally more adapted to wide, short bottles than narrow, tall bottles.

Various other types of retaining features for article carriers have been proposed in the past. One simple form of article retainer is shown in U.S. Pat. No. 2,425,140 and Australian Pat. No. 121,649 in which a pair of side flaps and a bottom flap are formed on the respective side and bottom panels of an article carrier. The side and bottom flaps are joined by a folding triangular section. When the carrier is assembled, the side flaps lie flat against the side panel of the carrier and are held in this position by the fold of the flaps. The triangular section joining each side flap with the bottom flap is forced inward to cause the bottom flap to be erected in an upright position to prevent articles from moving endwise out of the carrier.

However, such a retention arrangement also has several obvious disadvantages. First, there is a substantial amount of paperboard used in forming the blank that is wasted. In this case, the side and bottom flaps of necessity must be formed outboard of the boundaries defined by the side and bottom carrier panels. Second, the bottom retaining flap is kept in its erected position without direct, positive pressure of the end product containers. If the carriers or containers are shifted slightly, such as during shipping, the side panels may slip, thus allowing the retaining flap to be released accidentally.

It is also known to provide gusset-type retainers for article carriers. Such retaining gussets have generally taken the form of those shown in U.S. Pat. No. 2,371,312 and French Pat. No. 1,307,325 in which four gussets are arranged at the corners formed by the side and bottom panels of the article carrier. Each gusset includes two triangular sections and three fold lines.

The retaining feature is provided by snapping the middle fold over center so that the triangular sections point inwardly toward the articles contained within the carrier. This structure has the same disadvantage of not providing a positive holding feature, since the gussets can be easily released by the accidental shifting movement of the end product containers within the carrier against the folded gusset sections.

It is also known to combine the above-described features of side-panel flaps and gusset retainers. The carrier structure includes corner gussets disposed at the ends on both the top and bottom panels, which act to hold the containers in position when the carrier has been erected. A side flap is connected to both the upper and lower gussets and is folded against the inside of the side panel. The pressure of the end product containers bearing against the flaps is designed to hold the gussets in the erected retaining position. However, this construction suffers from the same disadvantage as previous designs in that the lower gusset sections project outwardly from the body of the carrier when erected. These projecting gussets waste paperboard, and also are likely to get mutilated, deformed and otherwise interfere with one another, especially when a number of these carriers are closely packed as would be the case when placed on a retailer's shelf or during shipping. The carrier of later U.S. Pat. No. 3,815,320 suffers the same type of shortcomings, and in addition does not use interconnecting sections so that a full gusset structure is not formed.

OBJECTIVES OF THE INVENTION

It is therefore an object of the invention to provide an article carrier having positive gusset retaining means.

It is an additional object to provide an article carrier in which the gusset retainers are securely held in their erected position by the weight of articles contained within the carrier.

It is a further object to provide an article carrier having gusset retainers which do not project beyond the edges of the article carrier.

It is yet an additional object to provide an article carrier having gusset retainers in which the amount of paperboard used in forming the carrier is minimized.

It is still further object to provide an article carrier having gusset retainers which is easily manufactured and readily erected by automatic machinery.

SUMMARY OF THE INVENTION

These and other objectives are achieved by the present invention wherein there is provided an article carrier of the wraparound type having top, bottom, and side panels separated by fold lines and including gusset retainers formed at the bottom corners of the carrier adjacent the fold lines separating the side and bottom panels. Each gusset retainer comprises first, second and third adjacent triangular gusset sections separated from each other and the bottom and side panels by fold lines. The gusset sections are arranged such that when the section adjacent the bottom panel is folded through 180° to lie on top of the bottom panel within the carrier, and the middle section is folded on top of the previously folded section, the remaining section adjacent to the side panel is automatically erected in its retaining position. The end product containers disposed within the carrier rest on the two folded sections to secure the retention of the retaining gussets and prevent movement of the containers.

The above arrangements have several advantages over previously known art article carrier retainers. First, the gusset sections are formed without special cuts or projecting portions along the sides of the carrier blank. This results in minimum wastage of the paperboard and reduced manufacturing costs. Second, the weight of the article containers is used to securely hold the gusset retainers in their erected position, thus insuring positive and secure retention of the articles. Third, the gusset portions are arranged having two 180° folds thus making it more difficult for the gusset retainers to be accidentally released if the container or carrier is shifted. Fourth, the folded over sections serve to form a resilient wedge under the outer edge of the bottles. This snugs the bottles together when the carrier is pulled tight around the bottles in the packaging machine. Last, since the gusset retainers do not project beyond the edges of the article carrier, they are unlikely to become mutilated, torn, or catch on adjacent carriers while on a retailer's shelves or during shipping.

BRIEF DESCRIPTION OF THE DRAWING FIGURES

Other objects, features, and advantages of the present invention will be apparent from the following detailed description taken in conjunction with the accompanying drawing figures wherein:

FIG. 1 is a plan view of a representative carrier blank embodying the retaining features of the present invention;

FIG. 2 is a perspective view of the article carrier of FIG. 1 in its erected position, showing six bottles in a 2×3 pattern enclosed within the carrier;

FIG. 3 is a detailed cutaway side view of one of the gusset retainers;

DESCRIPTION OF THE PREFERRED EMBODIMENT

Figure 4:
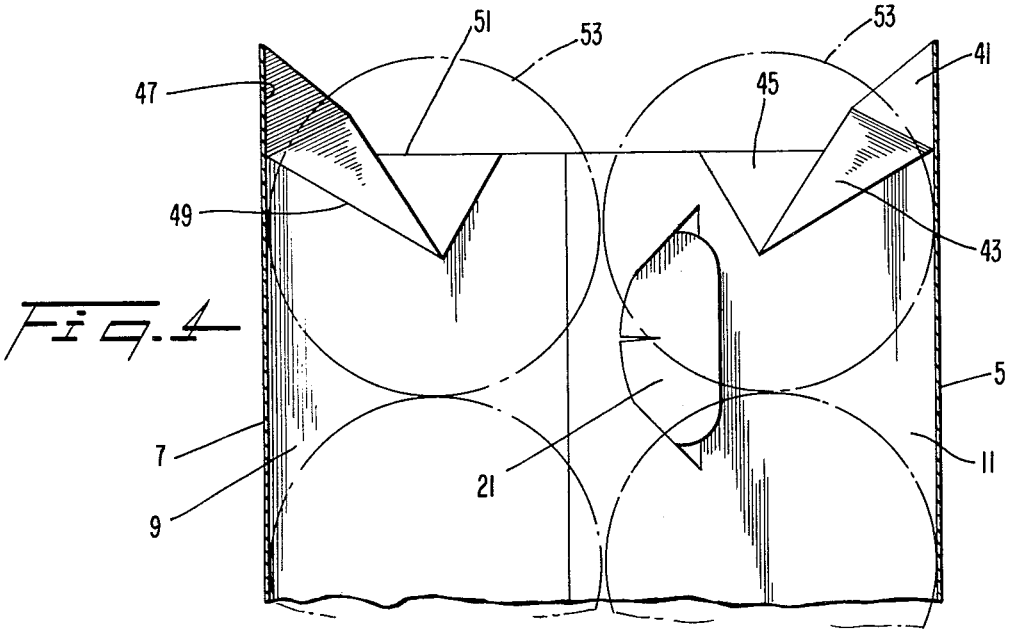
FIG. 4 is a cross-sectional interior view of one end of the carrier showing a pair of the gusset retainers in their erected position.

Referring to FIG. 1, there is shown a carrier blank 1 which includes retaining gussets constructed in accordance with the principles of the present invention. Carrier blank 1 is preferably formed from a single sheet of foldable material such as coated paperboard. The carrier blank has a generally elongated, rectangular shape, and is formed having a top panel 3, a pair of side panels 5 and 7, and a pair of bottom panel halves 9 and 11. The top, bottom, and side panels are separated by fold lines 13, 15, 17, and 19, as shown in FIG. 1.

Bottom panel half 9 has a pair of locking tabs and tongues 21 and 23, respectively, for lockably interfitting into slots 25, 26 formed on the other bottom panel half 11. The locking tabs and slots are used to join the bottom panel halves 9 and 11 together when the carrier blank 1 is assembled. The locking arrangement and construction is described more fully in the Pierce U.S. Pat. No. 3,374,938, assigned to the assignee of this invention.

The carrier 1 is formed having a pair of knock-out openings 27 on the top panel 3. Knock-outs 27 allow a user to readily lift the carrier and its contents when loaded. Also shown are a number of retainer openings 29 formed on the top panel 3 which act to retain the upper portion of the bottle within the carrier, as shown in FIG. 2. Of course, the size and arrangement of the openings 29 can be modified to accommodate different numbers and sizes of bottles, and even canned articles. A perforated strip such as shown in U.S. Pat. No. 3,374,938 may be formed on one or more of the side panels to enable a user to release the contents enclosed by the carrier. The arrangement and type of locking tabs, knock-out openings, and perforated strip is a matter of choice and plays no part in the operation of the present invention.

Identical upper gusset flaps 31 are formed integrally along opposite edges of top panel 3. The outer edge of the flaps 31 are in line with the outer edges of side panels 5 and 7. Flaps 31 are separated from the top panel proper by fold lines 33. A pair of triangular sections 35 and 37 are formed adjacent flaps 31 and side panels 5 and 7, respectively. Sections 35 are separated from flaps 31 by extensions of fold lines 13, and sections 37 are separated from flaps 31 by extensions of fold lines 15. This arrangement allows flaps 31 to be folded downwardly and snap over center to a position at approximately a right-angle to the top panel when the carrier is erected, as shown in FIG. 2.

A primary feature of the invention is the provision of a number of identical gusset means, denoted generally at 39, at the bottom of the carrier. Gussets 39 are located at the corners and are located adjacent the outer portions of fold lines 17 and 19 which separate the side and bottom panels. Each gusset 39 comprises three adjacent triangular sections 41,43, and 45, separated from each other and the side and bottom panels of the carrier by four fold lines. The first gusset section 41 is formed on a side panel 5 or 7 and is separated therefrom by fold line 47. Section 41 shares a common border (fold line 17 or 19 extension) with the second or middle gusset section 43, which is formed on a bottom panel half 9 or 11. The third gusset section 45 is also formed on a bottom panel half by fold lines 49 and 51, respectively. While FIG. 1 shows the gusset sections 41,43 and 45 as being approximately right-triangles, it is understood that within the broad aspects of the present invention, other types of triangular arrangements for the sections may be used. However, in the preferred embodiment shown, each gusset comprises three right triangular sections and four separating fold lines.

It will be noted that the above arrangement of gussets and other features of the article carrier result in minimum wastage of the blank from which the carrier 1 is cut. In this regard, as shown in FIG. 1, the gusset sections 41, 43, 45 do not project beyond the edge of the sides 5. That is, the edges of the first gusset section 41 are substantially in a straight line with respect to the edge of the panels 5. The outer edge of third gusset section 45 is an intersecting straight line when unerected (see FIG. 1). In addition, no perforated lines, only creased fold lines, are needed to form the gussets. This results in substantial savings in paperboard and manufacturing costs over the prior art carrier designs described.

FIG. 2 is a perspective view of the carrier blank 1 in its erected (assembled) configuration. A plurality of bottles or containers 53 are shown disposed in the carrier 1. As can be seen from the phantom line gusset and the cut-away portion of one corner of the carrier (FIG.

3), gussets 39 are adapted to be folded inwardly toward the interior of the carrier so as to act as a retaining means to hold bottles 53 securely within the carrier 1. The end containers 53 advantageously then rest on two of the folded gusset sections 43 and 45, while section 41 will be pivoted inwardly so as to act as a retainer for the bottles. In the case of bottled articles, openings 29 formed in the upper portions of side panels 5 and 7 align and restrain movement of the upper portion of the bottles. Gusset flaps 31 are also folded downwardly from top panel 3 to prevent further movement of the upper parts of bottles 53.

Figure 5:
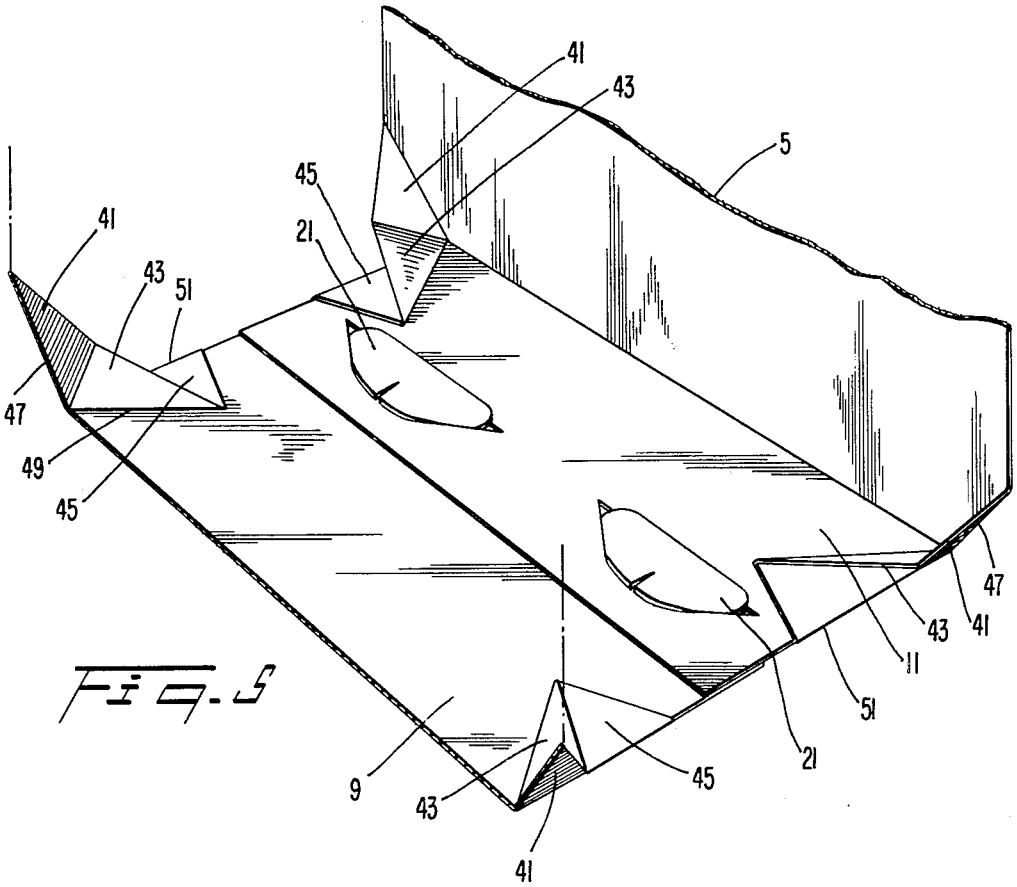
FIG. 5 is a detailed cutaway perspective view of the interior of the article carrier showing the arrangement of the gusset retainers in their erected position.

The preferred set up operation of gussets 39 will now be discussed with reference to the detailed views of the gusset structure shown in FIGS. 3 through 5. The carrier blank is adapted to be erected and wrapped around bottles 53 by automatic machinery well known in the art, such as shown in U.S. patent to Pierce U.S. Pat. No. 3,557,521, also owned by the assignee of the present invention. The blanks are pulled tight or "snugged" around the bottles by the erecting machinery with the bottom panels 9 and 11 being locked together by means of tabs 21 and slots 25.

As the carrier 1 is erected and locked, the gussets are erected or formed as follows. Section 45 is folded inwardly 180° about fold line 51 to lie on top of its adjoining bottom panel within the interior of carrier 1. Section 43 is simultaneously folded 180° about fold line 49 to lie on top of section 45. These two folding operations cause the remaining gusset section 41 to be erected in its retaining position folded in about line 47. The resultant fold line between gusset sections 41, 43 extends outwardly at an acute angle with respect to the edge of the bottom panels 9, 11 (see FIG. 4). In this position, section 41 is directed inwardly (toward the interior of the carrier) and held at an oblique angle with respect to the bottom and side panels. Since section 41 is articulated or pivotally attached to a side panel 5 or 7 and to gusset section 43 by fold lines 47, and 17 or 19, respectively, the alignment of retaining section 41 is automatic; i.e., erection of section 41 is assured once sections 43 and 45 have been folded to lie on top of the bottom panel.

The positioning of section 41 is not left to chance since the two overlying sections 43, 45 are not subject to any mispositioning or misalignment. The overlying sections also provide the advantageous localized wedging action that resiliently tightens the bottles in the carrier.

After the gusset retainers are formed, and the carrier fully wrapped around the bottles, the bottom panels are joined together by the locking tabs and slots 21, 25. At this point, weight of end bottles 53 rests directly on top of the folded over gusset sections 43 and 45. Thus, the weight of bottles 53 acts to hold the folded sections 43 and 45 securely in juxtaposition and against the bottom panel. This keeps the retaining section 41 properly aligned and erected so as to grip and retain the outer bottom edge portions of bottles 53.

In summary, the gusset retaining structure of the present invention has several advantages over prior art carrier retainers. First, the present gusset structure is simple to form, and creates little paperboard waste. Furthermore, the carrier blank incorporating the gusset retainers of the present invention may be readily erected with little modification of existing automatic "wraparound" packaging machinery. Second, weight of the articles within the carrier is used to secure the gussets, rather than mere over center or side pressure on the gusset panels. This results in more positive retention of the articles by the carrier and less likelihood that the gusset retainers will come undone, even when the carrier is shifted. Third, when erected, the inwardly directed gusset retaining sections 41 do not protrude beyond the periphery of the article carrier. This not only saves paperboard but results in less chance of mutilating or snagging the gussets on adjacent carriers while on store shelves or during shipping.

While the article carrier of the present invention has been described in considerable detail, it is understood that various changes and modifications may occur to persons of ordinary skill in the art without departing from the spirit and scope of the invention as defined in the appended claims.

What is claimed is:

1. In an article carrier of the type formed from a single sheet of foldable material and having a top panel, a pair of side panels, and a bottom panel and wherein said panels are separated by fold lines, the improvement comprising:

gusset means, formed adjacent said fold lines separating said side and bottom panels, for retaining a plurality of articles disposed within said carrier, each said gusset means comprising:

first, second and third adjacent triangular gusset sections separated from each other and said bottom and side panels by fold lines;

said first section formed on said side panel adjacent said fold line separating said side and bottom panels;

said second section formed on said bottom panel adjacent said fold line separating said side and bottom panels and adjoining said first section;

the edges of said side panels and the outer edges of said first and second gusset sections forming substantially a straight line when said carrier is unerected to conserve the use of said foldable material;

said third section formed on said bottom panel and adjoining said second section;

said article carrier being characterized in that when said third gusset section is folded 180° along said fold line separating said third section from said bottom panel so as to lie on top of said bottom panel within said article carrier, and said second gusset section is folded on top of said third section, said first gusset section is automatically erected to act as a retainer for articles contained within said carrier.

2. The article carrier of claim 1 wherein articles contained within said carrier rest on said second and third gusset sections to securely hold said first gusset sections in an erected position.

3. The article carrier of either claim 1 or claim 2 wherein said first gusset section is disposed at the bottom corners within the carrier but with the fold line between said first and second gusset sections extending at an acute angle outwardly with respect to the outer edge of said bottom panels in its erected position.

4. The article carrier of claims 1 or 2 wherein said first gusset section is disposed at an oblique angle with respect to said bottom and side panels when in its erected position.

5. The article carrier of claim 1 wherein the outer edge of each said gusset means is formed when unerected by two substantially straight, intersecting lines and the remainder at the periphery of said side and bottom panels and adjacent said fold lines separating said side and bottom panels.

* * * * *